US005518555A

United States Patent [19]

Ouyang et al.

[11] Patent Number: 5,518,555

[45] **Date of Patent: *May 21, 1996**

[54] CHROMIUM AND FLUORIDE FREE METAL TREATMENT

[75] Inventors: Jiangbo Ouyang, Media; William L. Harpel, Langhorne, both of Pa.

[73] Assignee: Betz Laboratories, Inc., Trevose, Pa.

[ * ] Notice: The term of this patent shall not extend beyond the expiration date of Pat. No. 5,401,333.

[21] Appl. No.: 396,942

[22] Filed: Mar. 1, 1995

Related U.S. Application Data

[63] Continuation-in-part of Ser. No. 107,384, Aug. 16, 1993, abandoned.

[51] Int. Cl.[6] ..... C23C 22/77

[52] U.S. Cl. ..... 148/251; 148/247

[58] Field of Search ..... 148/251, 247

[56] References Cited

U.S. PATENT DOCUMENTS

| | | | |
|---|---|---|---|
| 4,136,073 | 1/1979 | Muro et al. | 260/29.2 EP |
| 4,191,596 | 6/1990 | Dollman et al. | 148/247 |
| 4,783,224 | 11/1988 | Sako | 148/251 |
| 4,921,552 | 5/1990 | Sander et al. | 148/247 |
| 5,122,202 | 6/1992 | Dykstra et al. | 148/247 |
| 5,158,622 | 10/1992 | Reichgott et al. | 148/247 |
| 5,401,333 | 3/1995 | Ougand | 148/241 |

FOREIGN PATENT DOCUMENTS

| | | |
|---|---|---|
| 0016298 | 1/1980 | WIPO . |
| 0162611 | 4/1985 | WIPO . |

OTHER PUBLICATIONS

Derwent Abstract; 82–22514E.

*Primary Examiner*—Sam Silverberg
*Attorney, Agent, or Firm*—Alexander D. Ricci; Steven D. Boyd

[57] ABSTRACT

A heavy metal and fluoride free pretreatment for a metal surface which enhances corrosion resistance and surface adhesion properties is described. The pretreatment is an aqueous solution of an anionic polyacrylamide which can be rinsed or dried in place.

6 Claims, No Drawings

CHROMIUM AND FLUORIDE FREE METAL TREATMENT

This application is a Continuation-in-part of application Ser. No. 08/107,384 filed Aug. 16, 1993 now abandoned.

FIELD OF THE INVENTION

The present invention relates generally to a silicate free, non-chromate, non-fluoride, non-heavy metal coatings for metals. More particularly, the present invention relates to a treatment for metals which is free of silicate, chromate, fluoride and heavy metals which improves the corrosion resistance and adhesion properties of a metal surface. The present invention provides a treatment which may be dried in place and which is particularly effective at treating aluminum coil and formed aluminum.

BACKGROUND OF THE INVENTION

The purposes of the formation of a chromate conversion coating on a metal surface are to provide corrosion resistance, and improve adhesion of coatings. The conversion coating improves the adhesion of coating layers such as paints, inks, lacquers and plastic coatings. A chromate conversion coating is typically provided by contacting a metal surface with an aqueous composition containing hexavalent or trivalent chromium ions, phosphate ions and fluoride ions. Concerns exist regarding the pollution effects of the chromate or phosphate discharged into rivers or waterways by such processes. Because of the high solubility and the strongly oxidizing character of hexavalent chromium ions, conventional chromate conversion processes require extensive waste treatment procedures to control their discharge. In addition, the disposal of the solid sludge from such waste treatment procedures is a significant problem.

Attempts have been made to produce an acceptable chromate free conversion coating for metals such as aluminum. Chromate free conversion coatings based upon complex fluoroacids and heavy metals are known in the art, however, they have not enjoyed wide-spread commercial acceptance. U.S. Pat. No. 4,191,596 which issued to Dollman et al., discloses a composition for coating aluminum which comprises a polyacrylic acid and $H_2ZrF_6$, $H_2TiF_6$ or $H_2SiF_6$. The '596 disclosure is limited to a water soluble polyacrylic acid or water dispersible emulsions of polyacrylic acid esters in combination with the described metal acid at a pH of less than about 3.5.

U.S. Pat. No. 4,921,552 which issued to Sander et al., discloses a non-chromate coating for aluminum which is dried in place which forms a coating having a weight from about 6 to 25 milligrams per square foot. The aqueous coating composition consists essentially of more than 8 grams per liter dihydrohexafluozirconic acid, more than 10 grams per liter of water soluble acrylic acid and homopolymers thereof and more than 0.17 grams per liter hydrofluoric acid. The disclosure notes that it was believed that copolymers of acrylic acid would also be effective, however, no examples were given.

U.S. Pat. No. 4,136,073 which issued to Muro et al., discloses a composition and process for the pretreatment of aluminum surfaces using an aqueous acidic bath containing a stable organic film forming polymer and a soluble titanium compound. The disclosed polymers include vinyl polymers and copolymers derived from monomers such as vinyl acetate, vinylidene chloride, vinyl chloride; acrylic polymers derived from monomers such as acrylic acid, methacrylic acid, acrylic esters, methacrylic esters and the like; aminoalkyl, epoxy, urethane polyester, styrene and olefin polymers and copolymers; and natural synthetic rubbers.

An aqueous nonchromated coating for nonferrous metals such as aluminum is disclosed in U.S. Pat. No. 5,122,202 which issued to Dykstra et al. The coating contains an anionic polyacrylic/polyacrylamide copolymer, ammonium zirconium fluoride, nitric acid, water and optionally a mold inhibitor.

The environmental concerns which exist with respect to chromates have begun to arise with respect to heavy metals also. Typically, metal coatings which are chromate free employ some form of heavy metals such as zirconium or titanium as well as some form of fluoride.

SUMMARY OF THE INVENTION

The present inventors have discovered a metal pretreatment which enhances corrosion resistance and the surface adhesion properties. The metal coating of the present invention contains no heavy metals, silicate or fluoride. The coating of the present invention provides excellent paint adhesion and corrosion resistance. The coating of the present invention is formed from an aqueous solution of an anionic polyacrylamide. The aqueous solution is preferably dried in place although rinsing may be employed. Preferred methods of application include spraying, dipping, flow coating and roll coating. After application to the surface, the coating solution is preferably dried as by heating.

DETAILED DESCRIPTION OF THE INVENTION

It was discovered by the present inventors that anionic polyacrylamide copolymers provide a non-chrome/heavy metal, silicate and fluoride free pretreatment for metals. The pretreatment can be dried in place and provides corrosion resistance and adhesion properties.

The present invention will be described with respect to the treatment of metals such as aluminum and alloys thereof even though the technology has applicability for other metals such as galvanized steel, cold rolled steel and Galvalume® (a zinc-aluminum galvanized steel available from Bethlehem Steel Company).

The treatment solution of the present invention includes an anionic polyacrylamide copolymer in an aqueous solution. The treatment solution is substantially free of silicate, fluoride, chrome and other heavy metals. By substantially free, it is meant that these materials are not intentionally added while trace amounts may be present. The anionic polyacrylamide has a weight average molecular weight of from about 2000 to about 500,000. The acrylate/acrylamide ratio in the copolymer can vary from about 1:5 to 10: 1. The preferred polyacrylamide has a molecular weight of from about 20,000 to 350,000 and an acrylate/acrylamide ratio of from about 1:1 to 9: 1.

The anionic polyacrylamide is typically applied at room temperature. The workable pH for application is from about 5 to 13, preferably about pH 8–11. The concentration of the copolymer in the aqueous treatment solution can range from about 0.05% to about 2%. Preferably, the copolymer concentration is about 0.2%.

The treatment solution may be applied to the metal surface to be treated by any conventional means such as spraying, dip-squeegee, flow coating, roll coating and the like. Roll coating is generally preferred. The treatment solution of the present invention is preferably dried in place although rinsing may be employed if desired.

In addition to the polyacrylamide copolymer of the present invention, the treatment solution may also include nonionic or cationic surfactants such as Triton X-100 (a nonionic surfactant available from Union Carbide), Chemquat 508/40 (a cationic surfactant available from Chemax Inc. ), and Surfonic N-95 (a nonionic surfactant available from Jefferson Chemical Company).

The present invention will now be further described with reference to a number of specific examples which are to be regarded solely as illustrative and not as restricting the scope of the present invention. In these examples, the effectiveness of the treatment solution of the present invention was evaluated with a variety of paint adhesion tests familiar to those skilled in the art. These included: "T-Bend", the tendency for paint to disadhere from a 180° bend in the metal (OT equals perfect); "Cross-Hatch", the tendency of paint to disadhere from areas between closely spaced lines scribed through the paint; "T-Bend/Boiling DI Water", the tendency for paint to crack and flower at a 180° bend after boiling in DI water for 20 minutes. No paint cracking or flowering is considered as passing; "Reverse Impact/Boiling DI Water", the tendency for paint to disadhere from reverse impacted metal after boiling in DI water for 20 minutes; "Acidic Acid Salt Spray" (AASS) per ASTM B-287 (10= Perfect).

The polyacrylamide copolymer (PAM) of the present invention was tested in comparison to 3 commercial pretreatment solutions available from Betz Laboratories, Inc. The PAM employed in the examples was a 7:3 acrylate:acrylamide with a molecular weight of 200,000. The commercial pretreatment solutions comprised Betz Permatreat® 1500: a chromic acid base pretreatment; Betz Permatreat® 1011: a pretreatment including an acrylic acid/allyl ether copolymer and a fluotitanic acid; Betz DC-1903: a proprietary fluozirconic based pretreatment (all available from Betz Laboratories, Inc., Trevose, Pa.).

EXAMPLE 1

3003 alloy aluminum panels were treated with polyacrylamide co-polymer, Permatreat 1011, DC-1903, and Permatreat 1500. The procedure used to treat the panels comprised cleaning with an alkaline cleaner (DC-1675 available from Betz Laboratories) for 10 seconds at 55° C.; rinse with tap water for 5 seconds; squeegee; apply treatment solution. The test panels were painted with PPG polyester paint (Truform III white, 3HW72824) according to the manufacturer's specifications. Table I summarizes the test results.

TABLE I

| Treatment | TB* | TB/BW (IT) | RI | RI/BW | AASS (500 HRS) SCRIBE | FIELD |
|---|---|---|---|---|---|---|
| PT 1500 | IT | PASS | 10 | 10 | 9 | 10 |
| PT 1011 | IT | FAIL | 10 | 8 | 7 | 10 |
| DC-1903 | IT | FAIL | 10 | 4 | 7 | 10 |
| PAM | IT | PASS | 10 | 10 | 8 | 10 |

*TB: T-Bend
TB/BW: T-Bend/boiling water
RI: Reverse impact, impact force: 40 in-lbs.
RI/BW: Reverse impact/boiling water
AASS: Acetic acid salt spray

EXAMPLE 2

The polyacrylamide copolymer described above (alone and in combination with commercial surfactants) was tested in comparison with the above described commercial pretreatments. The tests were conducted on 3003 alloy aluminum test panels prepared as described in Example 1. Table II summarizes the treatment solutions and Table III summarizes the test results for two different polyester paints.

TABLE II

| Treatment Solutions: |
|---|
| 1. 15% PT 1500 |
| 2. 4.5% PT 1011 |
| 3. 7% DC-1903 |
| 4. 0.2% PAM |
| 5. 0.1% PAM and 0.1% Triton X-100 |
| 6. 0.1% PAM and 0.1% Chemquat 508/40 |
| 7. 0.1% PAM and 0.1% Surfonic N-95 |

TABLE III

| Treatment Solution | TB* | TB/BW (2T) | RI | RI/BW | AASS (500 HRS) SCRIBE | FIELD |
|---|---|---|---|---|---|---|
| | | Lilly Polyester (76102-1564) | | | | |
| 1 | 2T | PASS | 10 | 3 | 7 | 5 |
| 2 | 2T | FAIL | 10 | 1 | 6 | 3 |
| 3 | 2T | FAIL | 10 | 2 | 6 | 3 |
| 4 | 2T | PASS | 10 | 4 | 9 | 6 |
| 5 | 2T | PASS | 10 | 8.5 | 8 | 8 |
| 6 | 2T | PASS | 10 | 3 | 9 | 8 |
| 7 | 2T | PASS | 10 | 6 | 9 | 6 |
| | | PPG Polyester (3HW72265) | | | | |
| 1 | 2T | PASS | 10 | 9.5 | 9.5 | 10 |
| 2 | 2T | FAIL | 10 | 5 | 8 | 10 |
| 3 | 2T | FAIL | 10 | 9 | 9 | 10 |
| 4 | 2T | PASS | 10 | 9.5 | 9 | 10 |
| 5 | 2T | PASS | 10 | 9.5 | 9.5 | 10 |
| 6 | 2T | PASS | 10 | 9.5 | 9.5 | 10 |
| 7 | 2T | PASS | 10 | 9.5 | 9.5 | 10 |

*See Table I for the full text of abbreviations.

EXAMPLE 3

3003 alloy aluminum test panels were treated as described in Example 2. Two water-based double coat paints were applied by draw-down rod, and cured in accordance with the manufacturer's specifications. The panels were prepared as described in Example 1. Table IV summarizes the results using the treatment solution designation set out in Table II.

TABLE IV

| Treatment Solution | TB | TB/BW (2T) | RI* | RI/ BW | AASS (500 HRS) SCRIBE | FIELD |
|---|---|---|---|---|---|---|
| | | PPG Water-Based Two Coat System (KW 30355/KW 11376) | | | | |
| 1 | 2T | PASS | 10 | 9 | 7 | 6 |
| 2 | 1T | FAIL | 10 | 9 | 5 | 9 |
| 3 | 2T | FAIL | 10 | 7 | 5 | 6 |
| 4 | 1T | PASS | 10 | 10 | 8 | 9 |
| 5 | 1T | PASS | 10 | 10 | 7 | 7 |
| 6 | 2T | PASS | 10 | 10 | 8 | 5 |
| 7 | 1T | PASS | 10 | 9 | 7 | 7 |
| | | Lilly Water-Based Two Coat System (9051/90101-4842) | | | | |
| 1 | IT | PASS | 10 | 10 | 9 | 8 |
| 2 | IT | FAIL | 10 | 6 | 8 | 9 |
| 3 | IT | FAIL | 10 | 6 | 9.5 | 7 |
| 4 | IT | PASS | 10 | 9.5 | 9.5 | 9 |

TABLE IV-continued

| Treatment | | TB/BW | | RI/ | AASS (500 HRS) | |
|---|---|---|---|---|---|---|
| Solution | TB | (2T) | RI* | BW | SCRIBE | FIELD |
| 5 | IT | PASS | 10 | 9.5 | 9.5 | 8 |
| 6 | IT | PASS | 10 | 10 | 9.5 | 9 |
| 7 | IT | PASS | 10 | 10 | 9.5 | 8 |

*Reverse impact performed at 32 in-lb.

EXAMPLE 4

The polyacrylamide copolymer pretreatment of the present invention was evaluated as a sealer for an iron phosphate treatment on cold rolled steel. After application of the polyacrylamide, Lilly polyester paint was applied using a draw-down bar. 1 T-Bend panels were immersed in 82° C. DI water for one minute and the adhesion was checked using a tape pull-off method wherein no paint pull-off was considered passing. The processing sequence was: clean cold-rolled steel test panels with a non-phosphorus alkaline cleaner (KL4060 available from Betz Laboratories) for five seconds at 60° C.; rinse with ambient tap water for five seconds; spray apply a commercial iron phosphate treatment to provide a 33 milligram per square foot coating; spray applied the sealer solution to be tested. Table V summarizes the sealing solutions tested and Table VI summarizes the results of the paint adhesion tests for Lilly Polyester Paint 111383.

TABLE V

| Sealer Solutions |
|---|
| 1 Ambient tap water |
| 2 0.1% Betz Chemseal ® 765A, pH 5.0 (adjusted with $H_3PO_4$), 2 sec., 130° F. |
| 3 1% Betz Chemseal ® 765A, pH 4.5 (adjusted with NaOH), 2 sec., 100° F. |
| 4 0.5% Betz Chemseal ® 750, 2 sec., 140° F., (Cr based) |
| 5 0.5% Betz Chemseal ® 764, pH 3.7, 2 sec., 40° F. |
| 6 0.05% PAM, 2 sec., ambient temp. |

TABLE VI

| IT/DI IMMERSION TEST* | |
|---|---|
| SEALER SOLUTION | RESULTS |
| 1 | FAIL |
| 2 | FAIL |
| 3 | FAIL |
| 4 | PASS |
| 5 | FAIL |
| 6 | PASS |

*Paint: Lilly Polyester Paint (111383)

Tables I, III and IV show that the polyacrylamide copolymer treatment of the present invention provides pretreatment of an aluminum surface that is as good as or better than commercial pretreatments which contain heavy metals and/or fluorides. Table VI shows that the polyacrylamide treatment of the present invention provides for sealing of an iron phosphate coating on cold rolled steel as good as or better than commercial sealers.

While the present invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

What is claimed is:

1. A method of coating a metal surface which comprises contacting said surface with a treatment solution comprising an essentially silicate, chromium, fluoride and heavy metal free aqueous solution of an anionic polyacrylamide copolymer having a weight average molecular weight of from about 2.000 to about 500,000 and an acrylate to acrylamide ratio of from about 1:5 to 10:1, and a pH of from about 8–11.

2. The method of claim 1 wherein said aqueous solution is dried in place on said metal surface.

3. The method of claim 1 wherein said anionic polyacrylamide copolymer has a weight average molecular weight of from about 20,000 to 350,000 and an acrylate to acrylamide ratio of from about 1:1 to 9:1.

4. The method of claim 1 wherein said aqueous solution further includes a nonionic or cationic surfactant.

5. The method of claim 1 wherein said metal is aluminum or alloys thereof.

6. The method of claim 1 wherein said metal is steel.

* * * * *